United States Patent [19]

Kitagawa

[11] 4,201,109

[45] May 6, 1980

[54] ENVELOPE WAVEFORM GENERATOR FOR ELECTRONIC MUSICAL INSTRUMENTS

[75] Inventor: Hiroshi Kitagawa, Hamamatsu, Japan

[73] Assignee: Kabushiki Kaisha Kawai Gakki Seisakusho, Hamamatsu, Japan

[21] Appl. No.: 824,535

[22] Filed: Aug. 15, 1977

[51] Int. Cl.[2] ..... G10H 1/02; G06M 3/00

[52] U.S. Cl. ..... 84/1.26; 84/1.13; 364/722

[58] Field of Search ..... 84/1.13, 1.24, 1.26; 364/718, 719, 722

[56] References Cited

U.S. PATENT DOCUMENTS

| | | | |
|---|---|---|---|
| 3,515,792 | 6/1970 | Deutsch | 84/1.24 |
| 3,610,805 | 10/1971 | Watson | 84/1.13 |
| 3,632,996 | 1/1972 | Paine et al. | 364/722 |
| 3,952,623 | 4/1976 | Deutsch | 84/1.24 |
| 3,977,291 | 8/1976 | Southard | 84/1.13 |

OTHER PUBLICATIONS

M. Schwartz, Information Transmisson, Modulation, and Noise, 1970, pp. 138–140, 151–155.

*Primary Examiner*—Gene Z. Rubinson
*Assistant Examiner*—Forester W. Isen

[57] ABSTRACT

An envelope waveform generator for electronic musical instruments which has a circuit for converting envelope clock pulses into a clock frequency having the pulse density corresponding to a musical sound frequency to vary the envelope speed in response to the musical sound frequency, a circuit for converting the output clock pulse from the abovesaid circuit into a clock frequency having the pulse density corresponding to an attack, sustain or release of a key switch to thereby control the speed of the attack and release, a pulse density function generator composed of a function generator whose output changes at every constant number of output clock pulses from the second-mentioned circuit and a pulse density multiplier for controlling the clock pulse density with the output from the function generator, and an envelope counter for counting the output pulses from the pulse density function generator to provide the sum of the pulse density functions as an envelope waveform.

2 Claims, 5 Drawing Figures

ENVELOPE WAVEFORM GENERATOR FOR ELECTRONIC MUSICAL INSTRUMENTS

BACKGROUND OF THE INVENTION

1. Field of the Invention

This invention relates to an envelope waveform generator for use in electronic musical instruments.

2. Description of the Prior Art

For controlling the envelope of an attack and decay of a musical signal in conventional electronic musical instruments, there has usually been employed the method that charging and discharging voltages of a time constant circuit comprising a capacitor and a resistor is applied to a gate circuit to control it to open and close. With this method, however, a desired envelope control cannot be expected and fabrication of the circuits involved is also difficult.

Another method is to directly read out a memory circuit having stored therein a sampled envelope waveform. With this method, however, the memory capacity becomes very large and the bit number used also increases correspondingly. Further, for providing envelope waveforms which differ with polyphonic tone, it is necessary to provide many envelope waveform memory circuits or effect multiplex read. Moreover, this prior art method has the defect of requiring a large capacity memory circuit for alleviating the influence of a quantizing noise which is a defect of a PCM (Pulse Code Modulation) waveform. Further, in the prior art, the envelope speed is made constant regardless of the pitch of a sound but, in order to obtain a natural sound, it is necessary to increase or decrease the envelope speed depending upon the pitch of a sound.

SUMMARY OF THE INVENTION

A primary object of this invention is to provide an envelope waveform generator which produces a desired envelope waveform of an electronic musical instrument at a natural envelope speed, with the quantizing noise suppressed low, and is simple in construction.

To attain the abovesaid object, the envelope waveform generator of this invention comprises a circuit for converting envelope clock pulses into a clock frequency having the pulse density frequency corresponding to a musical sound frequency to vary the envelope speed in response to the musical sound frequency, a circuit for converting the output clock pulse from the abovesaid circuit into a clock frequency having the pulse density corresponding to an attack, sustain or release of a key switch to therby control the speed of the attack and release, a pulse density function generator composed of a function generator whose output changes at every constant number of output clock pulses from the second-mentioned circuit and a pulse density multiplier for controlling the clock pulse density with the output from the function generator, and an envelope counter for counting the output pulses from the pulse density function generator to provide the sum of the pulse density functions as an envelope waveform.

Other objects, features and advantages of this invention will become apparent from the following description taken in conjunction with the accompanying drawings.

DESCRIPTION OF THE PREFERRED EMBODIMENTS

Briefly stated, the principle of this invention is as follows: The density of clock pulses for generating an envelope waveform is changed in accordance with a musical sound to obtain a natural envelope speed and, further, a function generator is driven by the change in the pulse density to approximate the envelope waveform to a straight line, thereby suppressing quantizing noises.

The circuit means which changes the envelope waveform is provided with a rate multiplier for obtaining the envelope speed corresponding to a key being depressed and a code converter for controlling the rate multiplier corresponding to the key. In one embodiment, the function generator comprises a rate multiplier for controlling the pulse density and a ring counter for controlling the output pulse density of the rate multiplier; the ring counter provides an output count upon each occurrence of a constant number of pulses, and the rate multiplier is controlled by the output count of the ring counter to thereby yield an envelope. In another embodiment, the function generator, instead of employing the ring counter accumulates upon each occurrence of a constant number of clock pulses and provides $A_{j+1}=A_j+B$, wherein B is a constant, to thereby control the rate multiplier.

Figure 1:
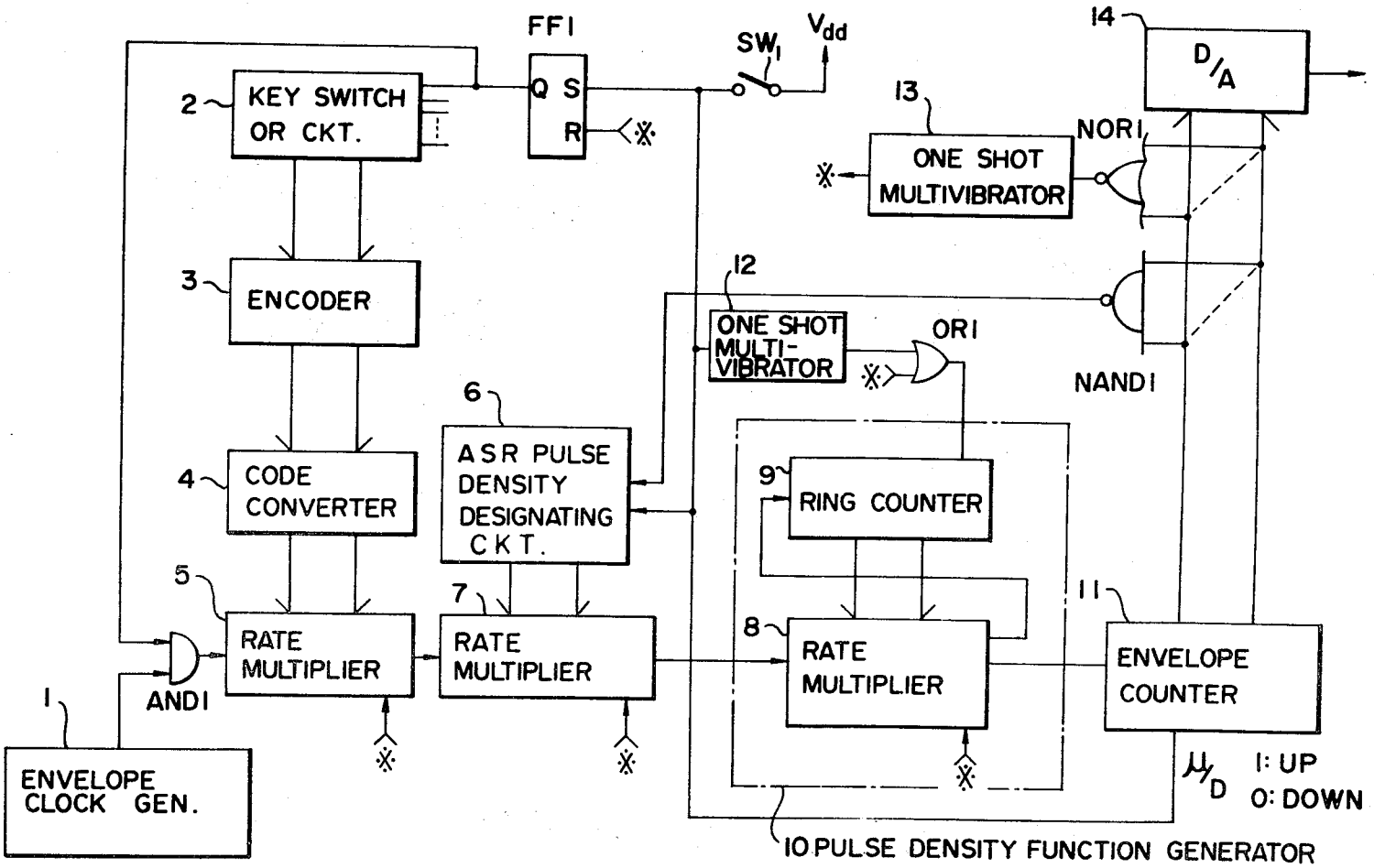
FIG. 1 is a block diagram illustrating the construction of an embodiment of this invention.
Figure 2:
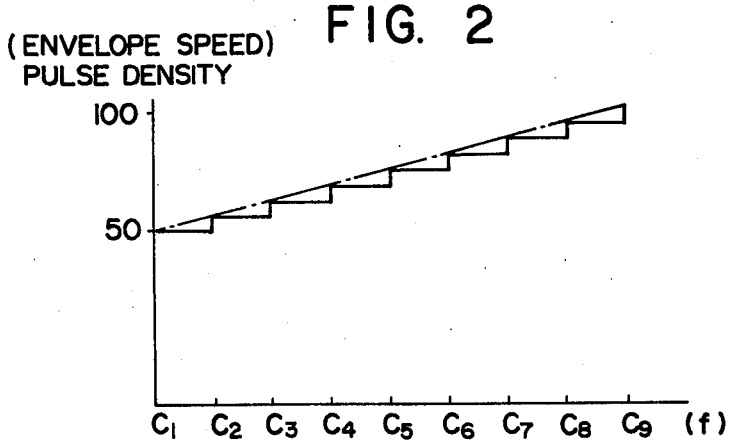
FIGS. 2 and 3A–3B are graphs explanatory of the characteristics of the principal part of the embodiment shown in FIG. 1.

FIG. 1 illustrates in block form am embodiment of this invention based on the abovesaid principle. In FIG. 1, an envelope clock pulse emanating from an envelope clock generator 1 is applied to an AND gate AND1. Upon turning ON a key switch SW1, a flip-flop FF1 is set to derive "1" at its Q output, which is applied to the AND gate AND1. As a result of this, the envelope clock pulse is fed to a rate multiplier 5, that is, a pulse density multiplier. The key switch SW1 is one of many switches of a key switch OR circuit 2. The output from the key switch OR circuit is encoded by an encoder 3 and the encoded output therefrom is applied to a code converter 4 to control the output pulse density of the rate multiplier 5. Here, it is the best to change the envelope clock frequency corresponding to each key but such high accuracy is not required in the sense of decreasing the number of control bits and to the human ear. It is sufficient to change the envelope clock frequency every octave. For example, in the case of changing the pulse density for each of keys covering the entire range of seven octaves, seven bits are needed but in the case of changing the pulse density every octave, only three bits will suffice. Therefore, in the present embodiment, the output of the key switch OR circuit 2 is divided corresponding to each octave and the encoder 3 produces octave codes. The code converter 4 controls the output pulse density of the rate multiplier 5 so that it may be K% and 100% of the input envelope clock pulses in the cases of the lowest and the highest octave, respectively. In this case, if the output pulse density is assumed to vary linearly, the output density varies as shown in FIG. 2. In the case of K being 50%, if the pulse density is divided into eight, the output from the code converter 4 becomes fourbit one. Also, it is easy to set some other suitable value than such a linear variation as shown in FIG. 2. The output envelope clock pulses from the rate multiplier 5, which has the pulse density corresponding to each octave, is applied to a rate multiplier 7. The rate multiplier 7 is supplied with the output from an attack, sustain and release pulse density designating circuit (hereinafter referred to as the ASR pulse density designating circuit) 6, which designates the envelope clock pulse density at the time of an attack, sustain or release of the key switch. The ASR pulse density designating circuit 6 is supplied with the outputs from the key switch SW1 and a NAND gate NAND1. The output from the key switch SW1 is "1" in the cases of the attack and the sustain and the output from the NAND gate NAND1 is "0" in the case of the sustain. With the combination of these outputs, the output pulse density of the rate multiplier 7 in the cases of attack, sustain and release is designated. The rate multiplier 7 is supplied with a 4-bit input to control the pulse density $$\frac{n}{16} \times 100\%$$

(n: 0, 1, . . . 15). In the case of the attack, a 100% pulse density is designated. During the attack, the rate multiplier 7 produces envelope clock pulses of the same pulse density as the output from the rate multiplier 5 and the envelope clock pulses are applied to a pulse density function generator 10, which provides the pulse density of a geometrical series given by a formula $A_{j+1}=A_j/2$ in the present embodiment. The circuit 10 comprises a 8-step ring counter 9 and a rate multiplier 8, and controls the number of output pulses therefrom to be in the range of 128 to 1 with respect to 256 input pulses.

Output pulses from rate multiplier 7 are counted, and ring counter 9 is driven one step for every 256 input pulses counted. That is, by driving the ring counter 9 one step every 256 input pulses, "1000000" is designated to provide a pulse density $$\frac{128}{256} \times 100\%.$$

Next, "0100000" is designated to provide a pulse density $$\frac{64}{256} \times 100\%$$

which is one-half of the abovesaid pulse density. In this manner, the number of output pulses varies such as 128, 64, 32, . . . 1 every 256 input pulses. The ring counter 9 may be replaced with a shift register in which "1" is written by one bit. The output from the rate multiplier 8 is applied to an envelope counter 11. With the output from the key switch SW1, the envelope counter 11 starts up-counting of "1", deriving therefrom $$\sum_{k=1}^{k=n} \frac{256}{2k},$$

n being 8. When the ring counter 9 designates "00000001", the envelope counter 11 counts 256 and all the bits become "1" to derive "0" from the NAND gate NAND1. The output from the NAND gate NAND1 is applied to the ASR pulse density designating circuit 6 to inhibit the rate multiplier 7 from providing an output, thereby stopping the attack and providing the sustain. The NAND gate NAND1 is to determine a steady value. Accordingly, it will suffice to set a suitable steady value.

Upon opening of the key switch SW1, "0" is applied to the ASR pulse density designating circuit 6 to designate a suitable pulse density $$\frac{n_R}{16} \times 100\%$$

of the release and the rate multiplier 7 outputs $n_R$ pulses with respect to sixteen input pulses. The output from the rate multiplier 7 is applied to the rate multiplier 8 of the pulse density function generator 10. In this case, the output from the key switch SW1 is applied to a oneshot multivibrator 12 to reset the ring counter 9 through an OR gate OR1, providing the status "10000000" again. Further, the output from the key switch SW1 is applied to the envelope counter 11 which is up-down counter to designate down-counting. The pulse density function generator 10 performs the same operation as in the case of attack to sequentially produce 128, 64, . . . 1 every 256 output pulses derived from the rate multiplier 7 and the envelope counter 11 performs down-counting from 225 to 0. When the envelope counter 11 has counted down to 0, the NOR gate NOR1 produces "1", which is applied to a one-shot multivibrator 13. The output from the one-shot nultivibrator 13 resets the rate multipliers 5, 7 and 8, the flip-flop FF1 and the ring counter 9 and the output Q from the flip-flop FF1 becomes "0" to inhibit the AND gate AND1 from permitting the passage therethrough of the envelope clock pulses.

Figure 3A:
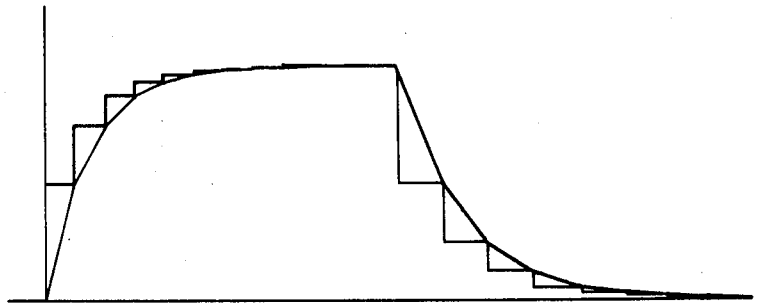
Figure 3B:
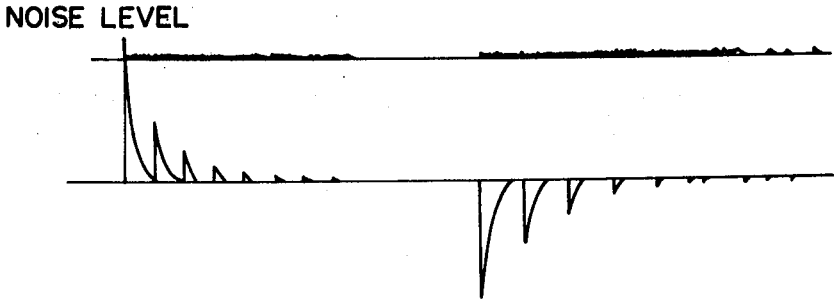

In FIG. 3 (*a*), there is illustrated the waveform of the output from the envelope counter 11 converted by a D-A converter 14 into an analog form. Also in the case where the key is released during attack, the ring counter 9 is reset and the release re-starts with the pulse density of $$\frac{128}{256} \times 100\%$$

and, by the output from the NOR gate NOR1, the envelope operation is stopped upon completion of the release. Also in the case where the key is pressed again during release, the ring counter 9 is reset by the one-shot multivibrators attack and decay 12 and 13 to start the attack again with the pulse density of $$\frac{128}{256} \times 100\%$$

and when the steady value set in the NAND gate NAND1 has been reached, the envelope operation is changed by the output of the NAND gate NAND1 from the attack to the sustain.

Figure 4:
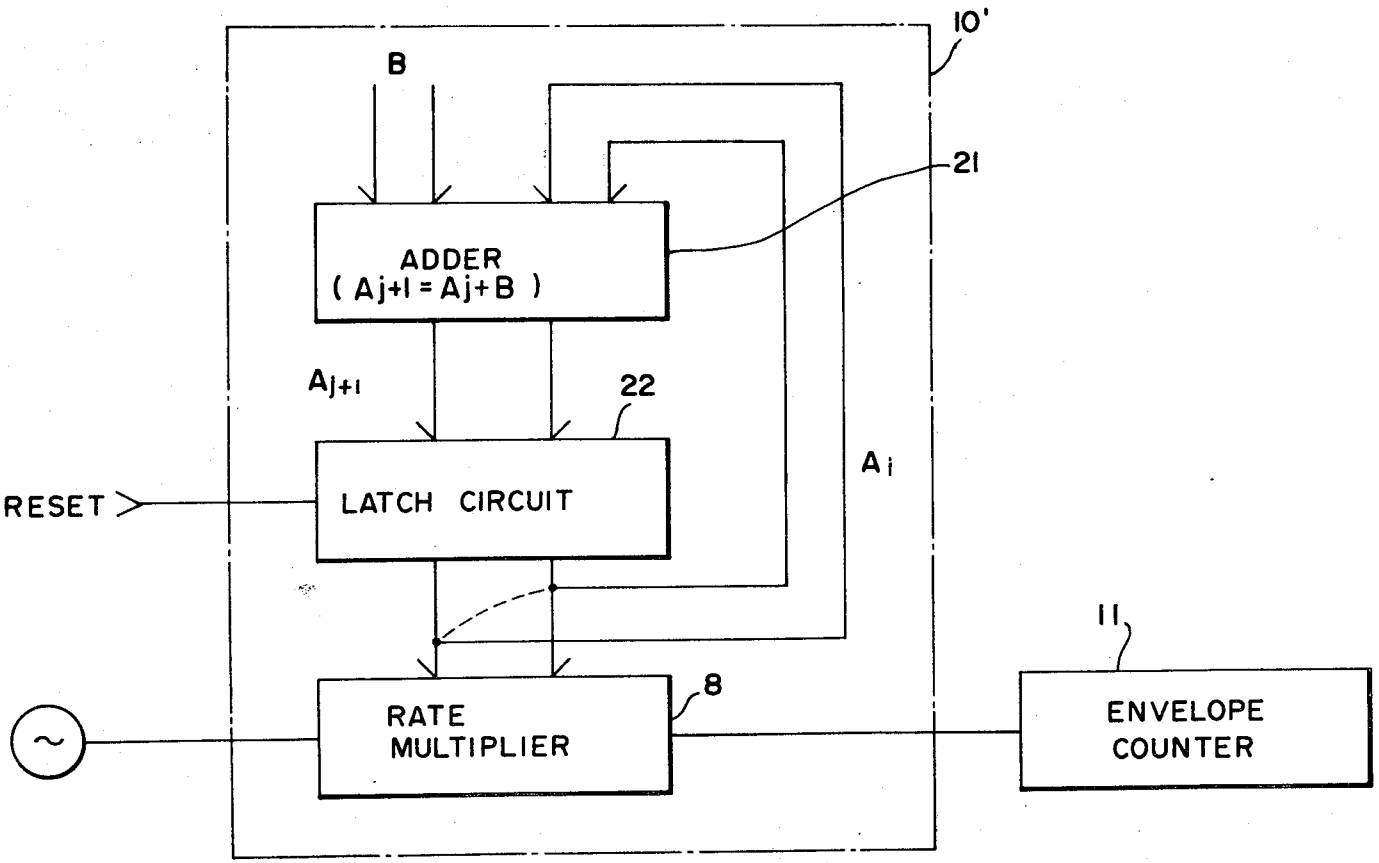
FIG. 4 is a block diagram showing the construction of another embodiment of this invention.

In the present embodiment, the pulse density function generator is adapted to provide the pulse density of $A_{j+1}=A_j/2$ which is a geometrical series. But it is also easy to obtain a pulse density function of a geometrical series expressed by a formula $A_{j+1}=A_j+B$, as shown in FIG. 4, and, in this case, the envelope waveform is outputted in the form of the sum of geometrical series.

That is, as shown in a pulse density function generator 10' indicated by the broken line, an adder 21 and a latch circuit 22 are connected in a loop and is provided in place of the aforementioned ring counter and $A_j$ is applied to the adder 21 together with B to derive the pulse density $A_{j+1}=A_{j+B}$ from the latch circuit 22. It is also possible to employ other functions.

In the present embodiment, the resulting envelope waveform becomes such as shown in FIG. 3 (*a*) that a PCM waveform having eight sample points is subjected to a straight-line approximation and, as shown in FIG. 3 (*b*), the quantizing noise is a noise of one step, and hence can thus be made low.

As has been described in the foregoing, according to this invention, an envelope clock pulse for forming an envelope waveform having the speed corresponding to the frequency of a musical signal can be obtained by a pulse density conversion, so that a natural envelope waveform and some other effects can be obtained. Further, since envelope data are obtained by the calculation of the function without employing any memory elements, the circuit of this invention is suitable for fabrication as an integrated circuit. In this case, by applying PCM waveform data to a rate multiplier to obtain a PNM (Pulse Number Modulation) waveform data, a straight-line approximation of the conventional PCM envelope waveform is made possible, so that the quantizing noise, which is the defect of the PCM waveform, can be reduced to a noise of one step of the lowest level.

It will be apparent that many modifications and variations may be effected without departing from the scope of the novel concepts of this invention.

What is claimed is:

1. An envelope waveform generator for electronic musical instruments, comprising:

a first circuit for converting envelope clock pulses from an envelope clock generator into a clock pulse train having a frequency proportional to a musical sound frequency, said first circuit being composed of a first rate multiplier receiving the envelope clock pulses and for producing an envelope speed corresponding to a key being depressed and a code converter for controlling said first rate multiplier corresponding to said key, said first rate multiplier thereby generating an output with a frequency proportional to said depressed key;

a second circuit being composed of an ASR pulse density designating circuit and a second rate multiplier, said second rate multiplier producing an output clock pulse with variable frequency in response to said ASR circuit, said frequency corresponding to the attack, sustain, and release portions of the envelope;

a pulse density function generator composed of a ring counter whose output changes upon each occurrence of a constant number of output clock pulses of said second rate multiplier and a third rate multiplier for controlling the output clock pulse frequency of said pulse density function generator in accordance with the output from said ring counter; and an envelope counter for counting the output pulses from said third rate multiplier to provide the sum of pulse density functions as an envelope waveform.

2. An envelope waveform generator for electronic musical instruments, comprising:

a first circuit for converting envelope clock pulses from an envelope clock generator into a clock pulse train having a frequency proportional to a musical sound frequency, said first circuit being composed of a first rate multiplier receiving the envelope clock pulses and for producing an envelope speed corresponding to a key being depressed and a code converter for controlling said first rate multiplier corresponding to said key, said first rate multiplier thereby generating an output with a frequency proportional to said depressed key;

a second circuit being composed of an ASR pulse density designating circuit and a secnd rate multiplier, said second rate multiplier producing a variable output clock pulse frequency in response to said ASR circuit, said frequency corresponding to the attack, sustain, and release portions of the envelope;

a pulse density function generator composed of a circuit including an adder for accumulation upon each occurrence of a constant number of output clock pulses of said second circuit to produce an output signal in accordance with the equation $A_{j+1}=A_j+B$ wherein $A_j$ is the present output from the adder, $A_{j+1}$ is the next output and B is a constant, a latch circuit connected in a loop with the adder, and a third rate multiplier controlled by the output from said latch circuit, said third rate multiplier producing said output of said pulse density function generator; and an envelope counter for counting the output pulses from said third rate multiplier to provide the sum of pulse density functions as an envelope waveform.

* * * * *